US009681747B1

(12) United States Patent
Pectol

(10) Patent No.: US 9,681,747 B1
(45) Date of Patent: Jun. 20, 2017

(54) FOLDING TABLE WITH POWER OUTLET

(71) Applicant: Mity-Lite, Inc., Orem, UT (US)

(72) Inventor: Matt Pectol, Orem, UT (US)

(73) Assignee: Mity-Lite, Inc., Orem, UT (US)

( * ) Notice: Subject to any disclaimer, the term of this patent is extended or adjusted under 35 U.S.C. 154(b) by 20 days.

(21) Appl. No.: 15/041,674

(22) Filed: Feb. 11, 2016

(51) Int. Cl.

| | |
|---|---|
| ***A47B 3/00*** | (2006.01) |
| ***A47B 21/06*** | (2006.01) |
| ***H01R 25/00*** | (2006.01) |
| ***A47B 3/08*** | (2006.01) |
| ***A47B 13/08*** | (2006.01) |

(52) U.S. Cl.
CPC ..... *A47B 21/06* (2013.01); *A47B 3/08* (2013.01); *A47B 13/083* (2013.01); *H01R 25/006* (2013.01); *A47B 2021/066* (2013.01)

(58) Field of Classification Search
CPC ..... A47B 21/06; A47B 3/08; A47B 13/083; A47B 2021/066; H01R 25/006
USPC ..... 108/115–135
See application file for complete search history.

(56) References Cited

U.S. PATENT DOCUMENTS

| | | | | |
|---|---|---|---|---|
| 2,306,209 | A * | 12/1942 | Jones | A47B 21/06 235/61 R |
| 3,072,451 | A * | 1/1963 | Greenberg | A47B 3/0913 108/132 |
| 3,128,344 | A * | 4/1964 | Goold | H01R 24/58 108/50.02 |
| 4,094,256 | A * | 6/1978 | Holper | A47B 21/06 108/33 |
| 6,422,157 | B2 * | 7/2002 | Rumph | 108/129 |
| 6,960,098 | B1 * | 11/2005 | Tseng | A47B 21/06 108/50.02 |
| 8,327,774 | B1 * | 12/2012 | Rivera | B60N 3/005 108/44 |
| 8,550,012 | B2 | 10/2013 | Rogers et al. | |
| 8,671,850 | B2 | 3/2014 | Smith et al. | |
| 2010/0064945 | A1 * | 3/2010 | Sierenberg | A47B 37/04 108/50.02 |

(Continued)

OTHER PUBLICATIONS

Wilkhahn; Folding tables with integrated outlets; accessed Jan. 18, 2016; 4 Pages; http://www.wilkhahn.com/en/office-for-motion/conference-dynamic-tables/.

(Continued)

*Primary Examiner* — Daniel J Troy
*Assistant Examiner* — Timothy M Ayres
(74) *Attorney, Agent, or Firm* — Thorpe, North & Western, LLP

(57) ABSTRACT

A folding table has an integrated electrical power outlet. The table has a tabletop with a horizontal orientation supported in an elevated position by at least a pair of legs or leg assemblies pivotally coupled at opposite sides of the tabletop and pivotal between a closed storage position against the tabletop and an open elevated position extending transverse to the tabletop. The tabletop has a bottom framework with a perimeter rail extending along at least a portion of a perimeter the tabletop and defining at least a portion of the perimeter of the tabletop. The perimeter rail is segmented and defines a rail gap in the perimeter rail, with the perimeter rail having opposing ends at the rail gap. The electrical power outlet is spliced into the perimeter rail at the rail gap and spans the rail gap in the perimeter rail.

20 Claims, 8 Drawing Sheets

(56) References Cited

U.S. PATENT DOCUMENTS

2013/0344731 A1* 12/2013 Shapiro ..... H01R 13/60
439/532

OTHER PUBLICATIONS

HICO; Folding tool stand (like a table) with power outlet; accessed Jan. 18, 2016; 4 Pages; http://www.hico-tools.com/index.php?route=product/product&product_id=58.
BKLYN Design; Table with outlet in perimeter; published Apr. 13, 2009; accessed Jan. 18, 2016; 3 Pages; http://media.designerpages.com/3rings/2009/04/bklyn-designs-%e2%80%9809-exclusive-video-preview-scott-behr-of-tmrnyc/.
GIZMODO; Table with outlet in perimeter; published Sep. 10, 2007;accessed Jan. 18, 2016; 1 Page; http://gizmodo/com/298365/custon-electric-table-has-plugs-right-in-the-table.
Global; Table with outlet in leg; accessed Jan. 18, 2016; 2 Pages; http://www.globalindustrial.com/p/work-benches/components/legs-shelves/workbench-leg-electric-outlet-with-power-cord.
SMARTdesk; Table with outlet in top; accessed Jan. 1, 2016; 14 Pages; http://www.smartdesks.com/cable-management-box.asp).

* cited by examiner

FOLDING TABLE WITH POWER OUTLET

RELATED APPLICATION(S)/PATENT(S)

This is related to U.S. Pat. Nos. 8,671,850 and 8,550,012, which are hereby incorporated herein by reference.

BACKGROUND

Field of the Invention

The present invention relates generally to portable, stackable, folding tables. More particularly, the present invention relates to an electrical power outlet for such a folding table.

Related Art

Folding, stackable tables allow for flexibility in arranging spaces. As portable computing devices have increased in popularity, the demand for electrical power has also increase. Typically, power outlets have been confined to wall outlets or large, immovable conference room tables.

SUMMARY OF THE INVENTION

It has been recognized that it would be advantageous to develop a folding table capable of providing electrical power to satisfy the increasing demands of portable computers, such as laptops, projectors, tablets and cellular phones. In addition, it has been recognized that it would be advantageous to develop a folding table capable of providing electrical power to resist haphazard placement of power or charging cords in walkways, along walls with wall outlets, and strung from wall outlets to tables. Furthermore, it has been recognized that it would be advantageous to develop a folding table capable of providing electrical power with an entire or whole, continuous, uninterrupted working surface; uninterrupted by holes or outlets.

The invention provides a folding table comprising a tabletop with a horizontal orientation supported in an elevated position with respect to a support surface by at least a pair of legs or leg assemblies pivotally coupled at opposite sides of the tabletop, and pivotal between a closed storage position against the tabletop, and an open elevated position extending transverse between the support surface and the tabletop. The tabletop has a bottom framework with a perimeter rail extending along at least a portion of a perimeter the tabletop, and defines at least a portion of the perimeter of the tabletop. The perimeter rail is segmented and defines a rail gap in the perimeter rail. The perimeter rail has opposing ends at the rail gap. An electrical power outlet is spliced into the perimeter rail at the rail gap, and spans the rail gap in the perimeter rail. The perimeter rail and the electrical power outlet together define a continuous perimeter.

In accordance with a more detailed aspect of the present invention, the perimeter rail can be segmented into separate and discrete rail segments; and the electrical power outlet can join the rail segments together.

In accordance with a more detailed aspect of the present invention, the at least a pair of legs or leg assemblies can have feet that oppose one another in the closed storage position against the tabletop, and can define a foot gap therebetween. The foot gap can have a width parallel with the tabletop defined between the feet, and a depth perpendicular to the tabletop. The electrical power outlet can have a plurality of electrical sockets carried in a housing. The housing of the electrical power outlet can have a thickness perpendicular to the tabletop less than the depth of the foot gap; such that the housing is recessed in the foot gap in the closed storage position. The housing can have a width parallel with the tabletop less than the width of the foot gap; such that the feet clear the housing in the closed storage position.

In accordance with a more detailed aspect of the present invention, the electrical power outlet can further comprise: a plurality of electrical sockets carried in a housing; and a mounting bracket coupled to the perimeter rail and carrying the housing. The perimeter rail can be tubular with a hollow interior. The opposing ends of the perimeter rail at the rail gap can be opposing open ends. The mounting bracket can comprise opposite wings extending into the opposing open ends, respectively, of the perimeter rail at the rail gap. Each of the opposite wings of the mounting bracket can have at least two flanges forming an L-shape to abut to at least two walls, respectively, of the perimeter rail. Each of the opposite wings can have a cap extending across a respective opposing open end of the perimeter rail. The electrical power outlet can further comprise the mounting bracket having a central body spanning the rail gap between the opposing ends of the perimeter rail. The central body can have a notch between the opposing ends of the perimeter rail to accommodate the plurality of electrical sockets at least partially between the opposing ends of the perimeter rail. The mounting bracket can have a molding circumscribing the notch with the molding being substantially flush with the perimeter rail. The central body of the mounting bracket can have a primary indentation or recess in an outer face thereof and circumscribed by the molding. A faceplate can be coupled to the mounting bracket and can be received in the primary indentation or recess of the central body. The faceplate can have a plurality of openings corresponding to the plurality of electrical sockets. The housing can have a thickness perpendicular to the tabletop thicker than a thickness of the mounting bracket perpendicular to the tabletop. The faceplate can have a thickness perpendicular to the tabletop that extends beyond the notch, and with an outermost edge extending at least as far as a bottommost of the housing. A secondary indentation or recess can be in the outer face of the central body of the mounting bracket circumscribed by the primary indentation or recess. A pair of flanges can extend from opposite lateral sides of the housing and can be received in the secondary indentation or recess. An inner tab can extend inwardly from the central body of the mounting bracket and can abut to a lower surface of the tabletop. A brace can extend between the central body of the mounting bracket and the inner tab.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Definitions

The term "support surface" is used herein to designate a surface upon which the foldable table is places, including by way of example, a floor, the ground, a stage, etc. upon which the table is disposed or supported.

The term "electrical power outlet" is used herein to refer to an outlet to receive an electrical plug and to provide electricity to power and/or charge an electronic device, and/or to provide data.

The term "electrical socket" is used herein to refer to one portion of an electrical coupling to transmit electricity to power or charge an electrical device, such as a laptop computer, an image projector, a tablet computer, a cellular phone, etc. The electrical socket can be or can have a hollow (which can be designated as female) to receive a plug. In addition, the electrical socket, or the electrical coupling, can transmit data. The electrical socket can be or can include a standard 120 v electrical outlet. In addition, the electrical socket can be or can include a standard USB port (an associated control electronics and/or transformers).

The term "perimeter" is used herein to designate a lateral, outer edge or boundary.

The term "splice" is used herein to describe a joint formed by overlapping, uniting or joining.

DESCRIPTION

As illustrated in FIGS. 1-14, a folding table, indicated generally at 10, in an example implementation in accordance with the invention is shown with an electrical power outlet, indicated generally at 14. The folding table 10 with the power outlet 14 provides a portable, foldable, stackable table that can be easily transported and stored, while providing an integrated power outlet to power electronic devices, such as laptop computers, tablet computers, cellular phones, projectors, and the like. The folding table 10 with the power outlet 14 provides user's ready access to electrical power from their seated position at the table, and resists numerous power cords from being strung across walkways from wall outlets to the table. Thus, the present table can increase convenience and safety. In addition, the foldable table 10 can be configured to protect the power outlet 14 from damage during transportation and storage. Furthermore, the foldable table 10 can provide an entire or whole, continuous, uninterrupted working surface; uninterrupted by holes or outlets in the working surface.

Figure 1:
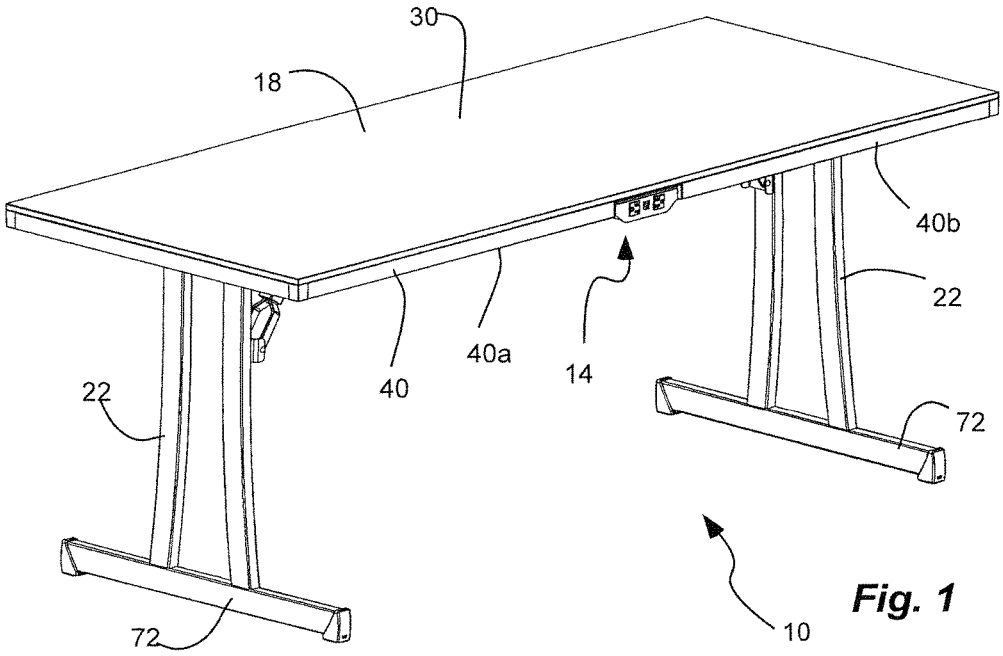
FIG. 1 is a perspective view of a foldable table with a power outlet in accordance with an embodiment of the present invention, with the table shown in a use configuration and with a tabletop with a horizontal orientation supported in an elevated position with respect to a support surface by at least a pair of legs or leg assemblies in an open elevated position extending transverse between the support surface and the tabletop.
Figure 8:
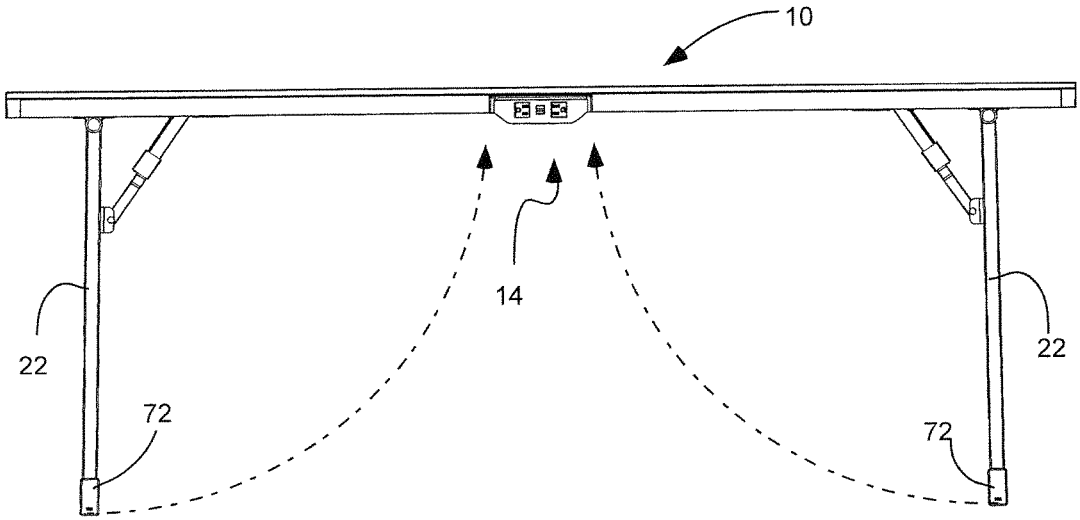
FIG. 8 is a front view of the table of FIG. 1, showing the pair of legs or leg assemblies in the open elevated position and pivoting to the closed storage position.
Figure 4:
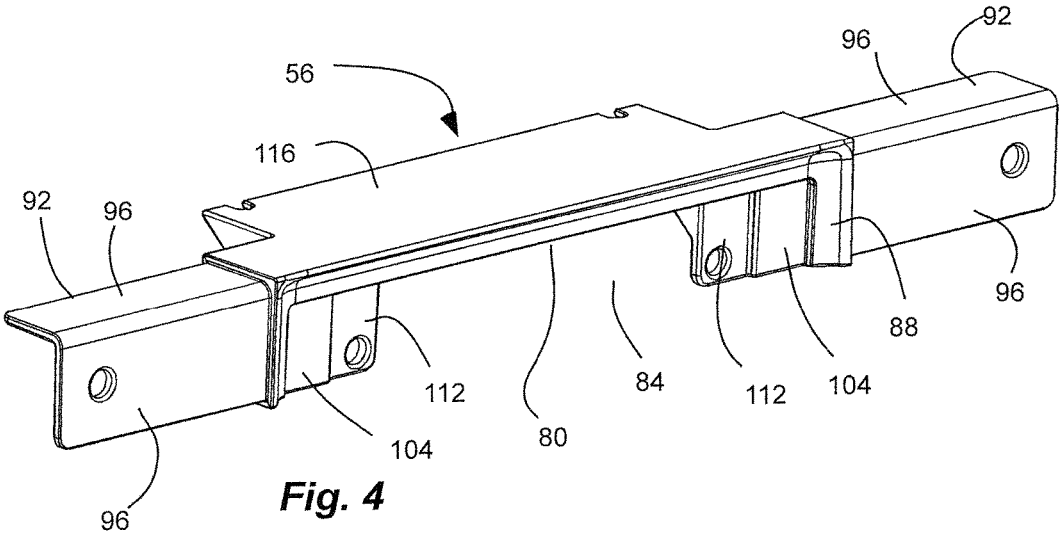
FIG. 4 is a perspective view of a mounting brace of the power outlet of the table of FIG. 1.
Figure 5:
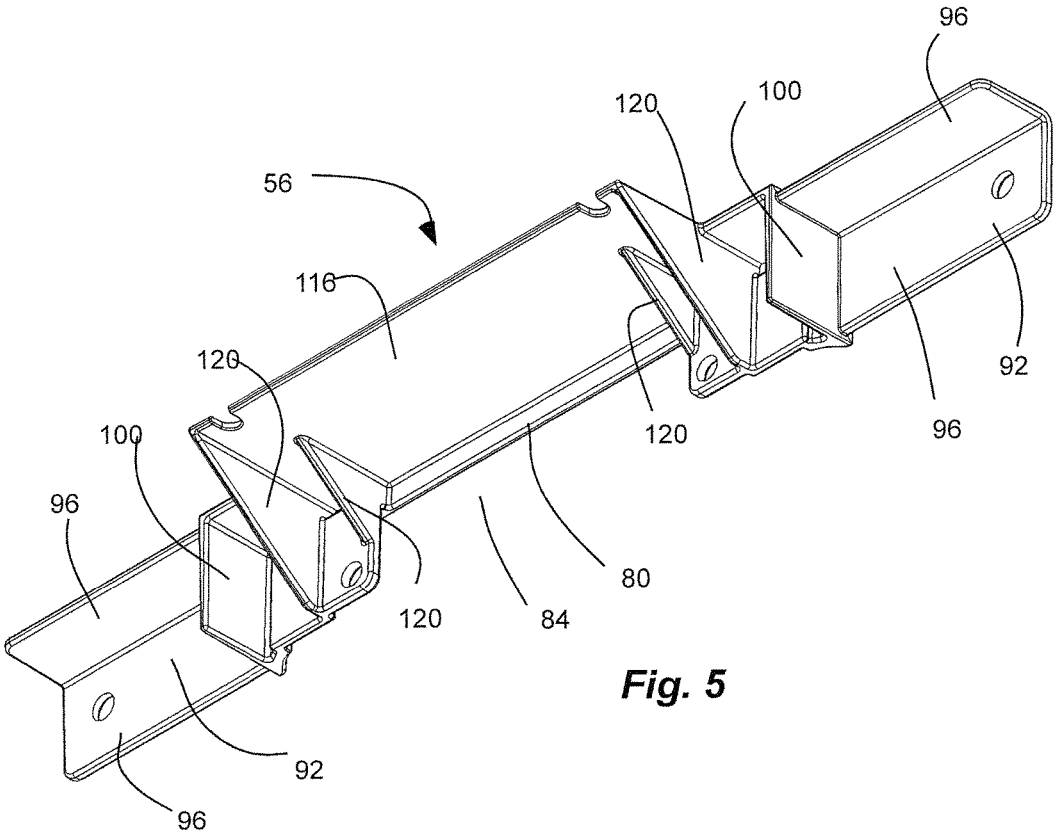
FIG. 5 is a perspective view of a mounting brace of the power outlet of the table of FIG. 1.
Figure 9:
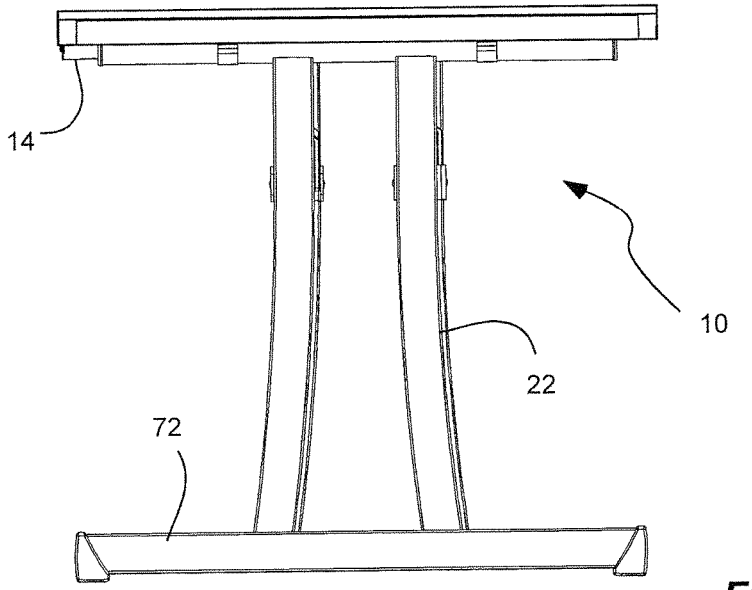
FIG. 9 is a side view of the table of FIG. 1.
Figure 7:
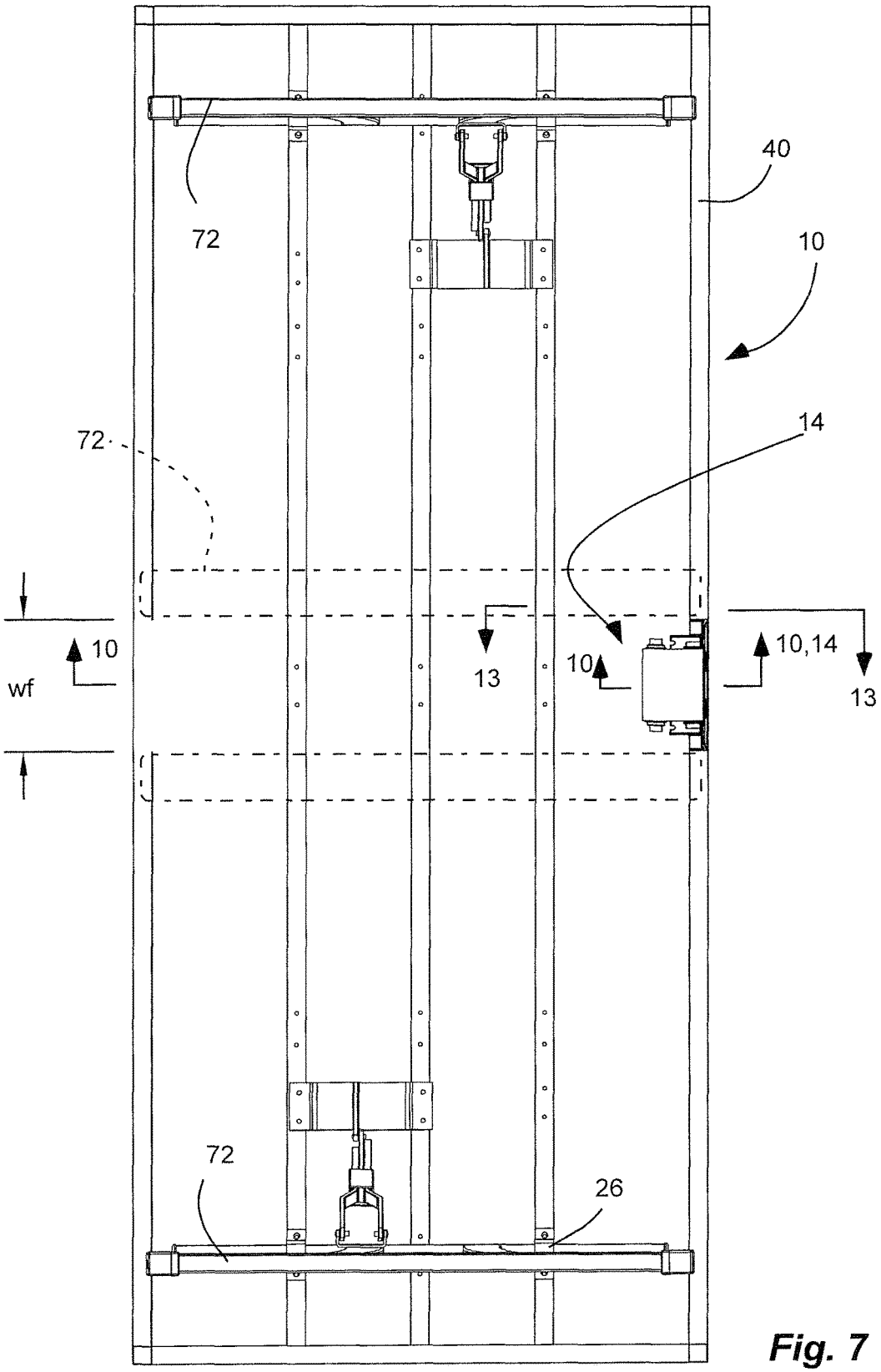
FIG. 7 is a bottom view of the table of FIG. 1.

The folding table 10 can comprise a tabletop 18 with a horizontal orientation supported in an elevated position (shown in FIGS. 1, 8 and 9) with respect to a support surface by at least a pair of legs or leg assemblies 22. For example, the table or tabletop can be elongated with a pair of leg assemblies disposed on either end or opposite halves thereof. The pair of legs or leg assemblies 22 can be pivotally coupled at opposite sides of the tabletop 18, such as with hinges 26 (FIGS. 7 and 8). The pair of legs or leg assemblies 22 can be locked in position with leg locks or links. The pair of legs or leg assemblies 22 can be pivotal between a closed storage position against the tabletop 18 (FIG. 2), and an open elevated position extending transverse between the support surface and the tabletop 18 (FIGS. 1, 8 and 9). In one aspect, the pair of legs or leg assemblies 22 can fold against a bottom of the tabletop, as shown. Thus, a thickness of the table in the closed storage position can be defined by the tabletop and the pair of legs or leg assemblies 22. In another aspect, the pair of legs or leg assemblies can fold into, or at least partially into, the table top.

The tabletop 18 can have a panel 30 with an uppermost surface defining a working surface, and a bottom framework 36 supporting the panel. The panel can comprise a sheet, such a plywood or laminate. The bottom framework can comprise a perimeter rail 40, such as tubular metal with a hollow interior, supporting the panel or sheet, and extending around some or all of a perimeter of the tabletop. In one aspect, the perimeter rail can extend around an entire periphery of the tabletop or panel. In another aspect, the perimeter rail can extend along all linear sides and ends of the tabletop or panel. In addition, the bottom framework can comprise intermediate spars extending across the table, and coupled to the perimeter rail. The perimeter rail 40 can extend along at least a portion of a perimeter of the panel. In addition, the perimeter rail 40, or outer face thereof, can be substantially flush with the perimeter of the panel. Together, the perimeter of the panel and the perimeter rail can define a perimeter of the tabletop. In one aspect, the perimeter of the tabletop, and thus the perimeter of the panel and the perimeter of the perimeter rail, can be continuous and uninterrupted to resist snagging.

Various aspects of the foldable table are described in U.S. Pat. Nos. 8,671,850 and 8,550,012, which are hereby incorporated herein by reference.

The perimeter rail 40 can be segmented to define a rail gap 46 (FIG. 11) in the perimeter rail. The perimeter rail 40 can have opposing ends 52 (FIG. 11) at the rail gap 46.

Figure 11:
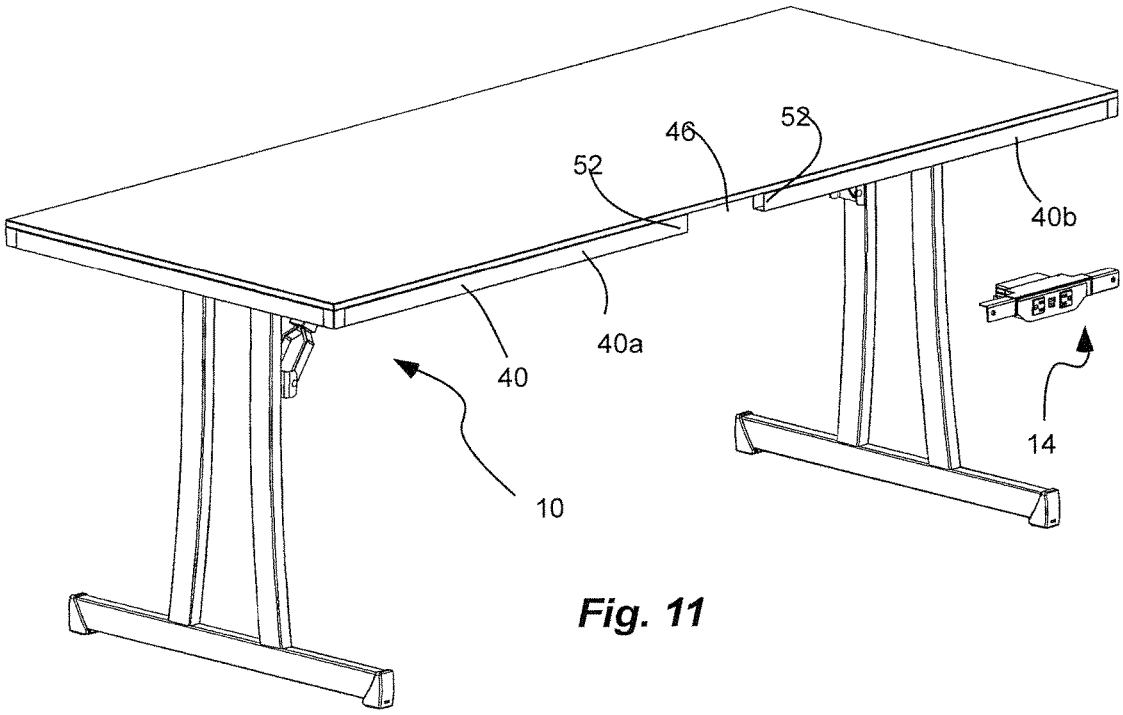
FIG. 11 is an exploded perspective view of the table of FIG. 1.

As described above, the perimeter rail 40 can be tubular with a hollow interior. Thus, the opposing ends 52 of the perimeter rail at the rail gap can be opposing open ends, or open and facing one another. The electrical power outlet 14 can be spliced into the perimeter rail 40 at the rail gap 46, and can span the rail gap in the perimeter rail. The perimeter rail 40 and the electrical power outlet 14 together can define a continuous perimeter of the perimeter rail and/or the tabletop. In order to accommodate the size or thickness of the power outlet, the perimeter rail 40 can be segmented into separate and discrete rail segments 40*a* and 40*b* (FIG. 11). The electrical power outlet 14 can join or unite the rail segments 40*a* and 40*b* together. In one aspect, the power outlet can provide a structural connection between the rail segments to form part of the perimeter rail, and thus to structurally support the panel or sheet of the tabletop along with the perimeter rail. Splicing the power outlet into the perimeter rail can position the power outlet at a convenient location for use. Providing the structural connection can allow the perimeter rail to continue to structurally support the panel or sheet while providing the power outlet at an advantageous location. The structural support of the power outlet can comprise a mounting bracket 56, as discussed in greater detail below. The mounting bracket 56 can be coupled to the perimeter rail, and can span the rail gap 46, and can splice and/or join the rail segments 40*a* and 40*b* together to form the perimeter rail 40. The mounting bracket 56 and the rails segments 40*a* and 40*b* can overlap one another.

The electrical power outlet 14 can comprise a plurality of electrical sockets 60 carried in a housing 64. The electrical sockets 60 can include one or more conventional 120*v* electrical outlets, and/or one or more conventional USB ports. The housing 64 can be completely enclosed, except for the electrical sockets 60, and one or more power cords 66 extending from the housing to another power supply (such as a wall outlet). The housing 64 can also contain associated control electronics and/or transformers associated with the USB ports. In addition, the housing 64 can have a pair of flanges 68 (FIG. 3) extending from opposite lateral sides of the housing to facilitate mounting of the housing, as discussed in greater detail below. The housing 64 can be mounted to and carried by the mounting bracket 56.

Figure 2:
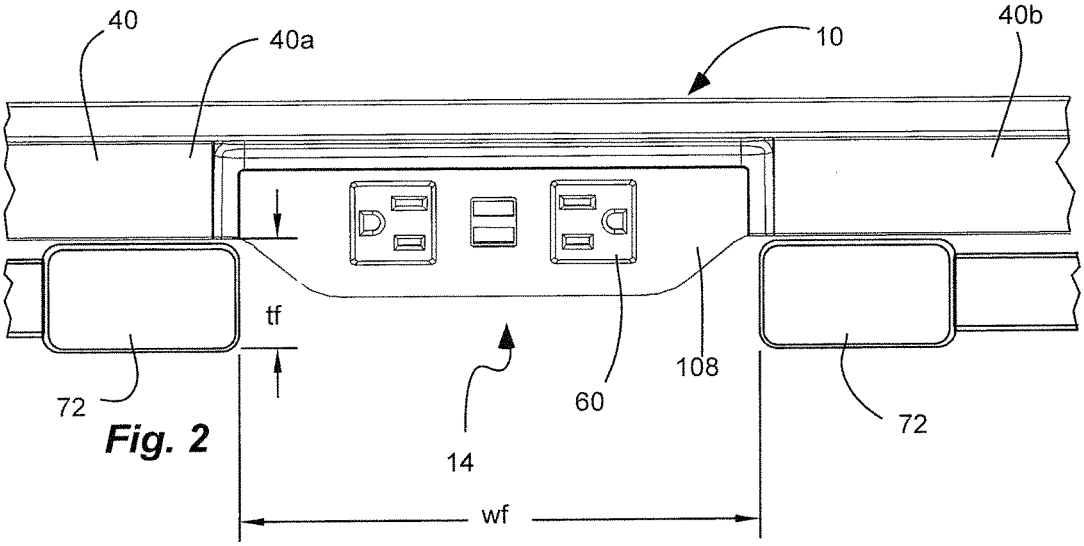
FIG. 2 is a partial, detailed front view of the table of FIG. 1, shown with the table in a storage configuration and the pair of legs or leg assemblies pivoted to a closed storage position against the tabletop.
Figure 10:
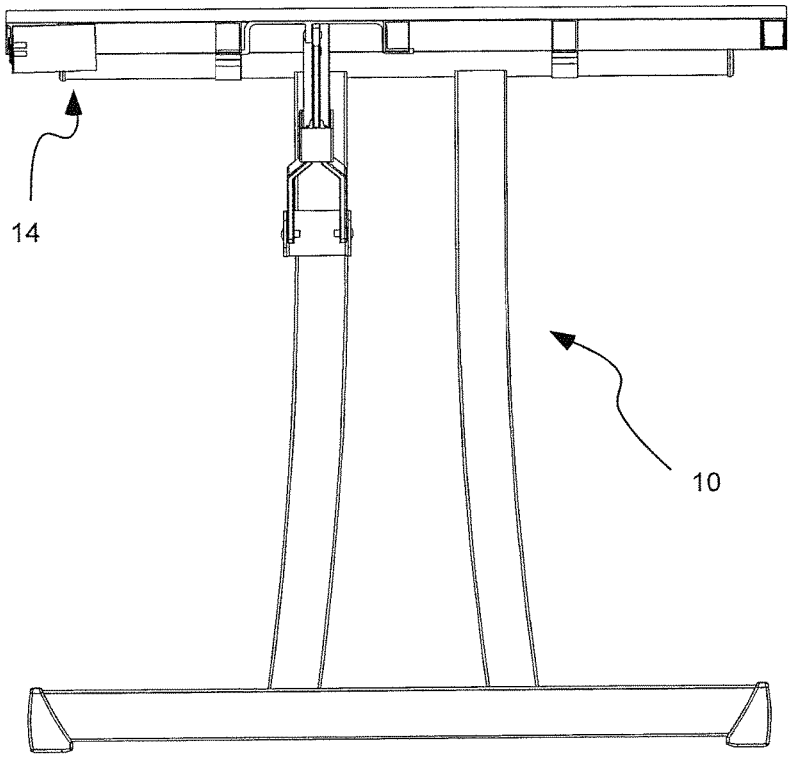
FIG. 10 is a cross-sectional side view of the table of FIG. 1, taken along line 10 of FIG. 7.

The power outlet 14 and/or the housing 64 can be located to protect the power outlet during transportation and storage of the table. For example, the power outlet 14 and/or housing 64 can be located at a midpoint of the table, and can be nested between the legs or feet in the closed storage position. The pair of legs or leg assemblies 22 can have feet 72 that oppose one another in the closed storage position against the tabletop, and defining a foot gap 76 therebetween, as shown in FIG. 2. The foot gap 76 has a width $w_f$ (parallel with the tabletop) defined between the feet 72, and a depth $t_f$ (perpendicular to the tabletop). The housing 64 of the electrical power outlet 14 can have a thickness $t_o$ (perpendicular to the tabletop, as shown in FIG. 10) less than the depth $t_f$ of the foot gap 76, as shown in FIG. 2.

Thus, the housing 64 and outlets 60 are recessed in the foot gap 76 in the closed storage position. In addition, the housing 64 can have a width $w_h$ (parallel with the tabletop) less than the width $w_f$ of the foot gap 76. Thus, the feet 72 clear the housing 64 in the closed storage position, and while pivoting between the closed storage position and the open elevated position.

Figure 6:
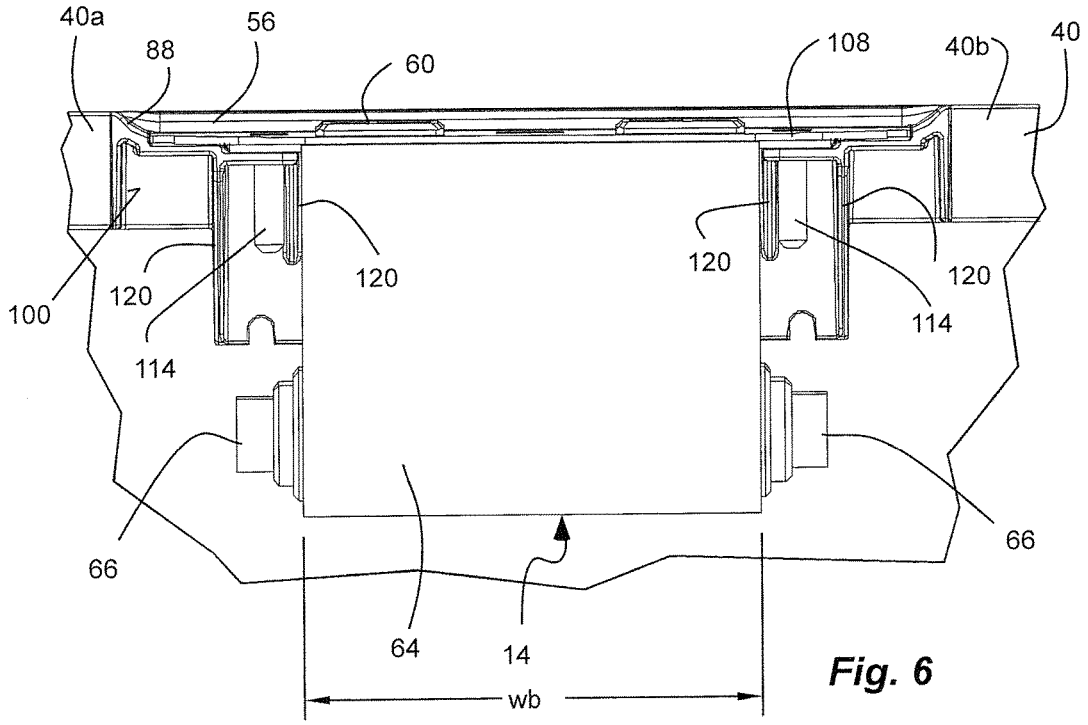
FIG. 6 is a partial bottom view of the table of FIG. 1 and a bottom view of the power outlet.

The power outlet or mounting bracket 56 can provide a structural connection between the rail segments 40*a* and 40*b* to form part of the perimeter rail 40, and thus to structurally support the panel or sheet of the tabletop along with the perimeter rail. The mounting bracket 56 can be configured to splice the power outlet and/or plurality of electrical sockets into the perimeter rail. The mounting bracket 56 can have a central body 80 that spans the rail gap 46 between the opposing open ends 52 of the perimeter rail 40. The central body 80 can have a notch 84 between the opposing open ends 52 of the perimeter rail 40 to accommodate the plurality of electrical sockets 60 at least partially between the opposing open ends 52 of the perimeter rail 40. Locating the electrical sockets 60 in-line with the rail can help reduce the thickness of the table in the closed storage position. The notch can open or face away from the table to allow the electrical sockets and/or housing to extend beyond the mounting bracket. A molding 88 (FIG. 4) can circumscribe (extend at least partially around) the notch 84 of the central body 80. The molding 88 can be substantially flush with the perimeter rail 40, as shown in FIG. 6, to cover edges of the open ends 52 of the perimeter rail 40, and to resist injury or snagging thereon. (The molding 88 can form or define an outermost perimeter of the electrical power outlet 14 that is substantially flush with the perimeter of the tabletop, the panel, and/or the rail, to resist snagging.) The mounting bracket 56 can have opposite wings 92 extending from opposite sides of the central body 80. The wings 92 can extend into and can be inserted into the opposing open ends 52, respectively, of the perimeter rail 40 at the rail gap 46. Thus, the wings 92 of the mounting bracket 56, and thus the power outlet, can overlap with the perimeter rail (and/or rail segments), and can be spliced into the perimeter rail. The wings 92 can be recessed with respect to the molding 88, again so that the molding can cover the edges of the open ends of the rail. Or the molding 88 can be raised with respect to the wings 92 to cover the edges of the rail.

Figure 12:
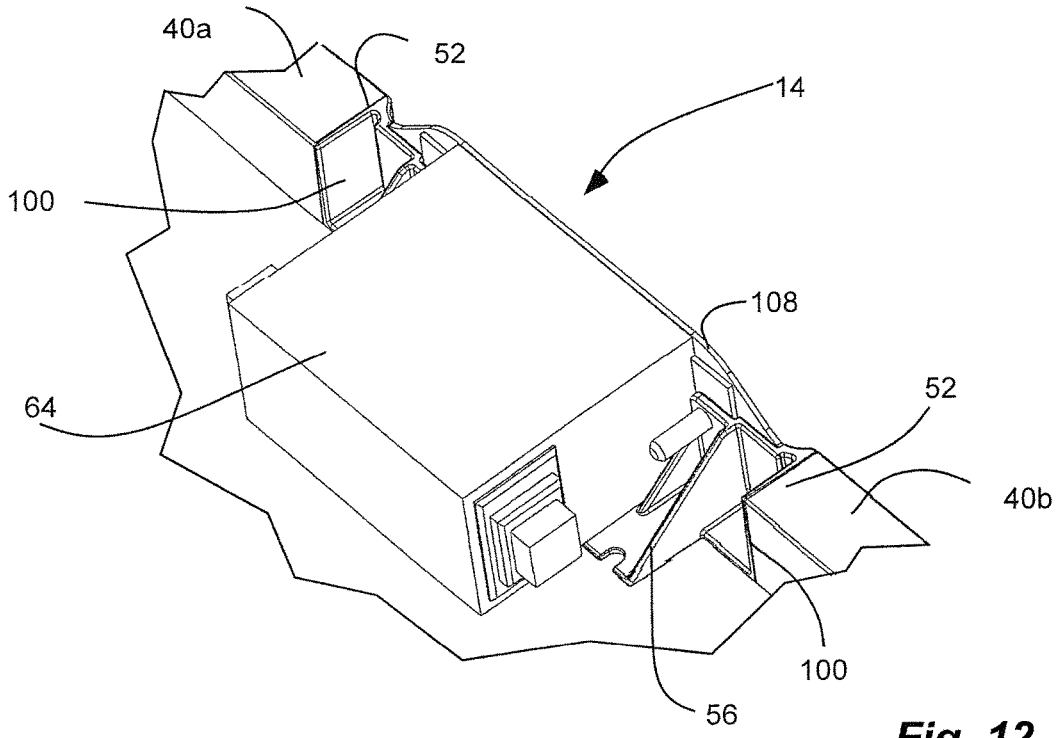
FIG. 12 is a partial bottom perspective view of the power outlet of the table of FIG. 1.
Figure 13:
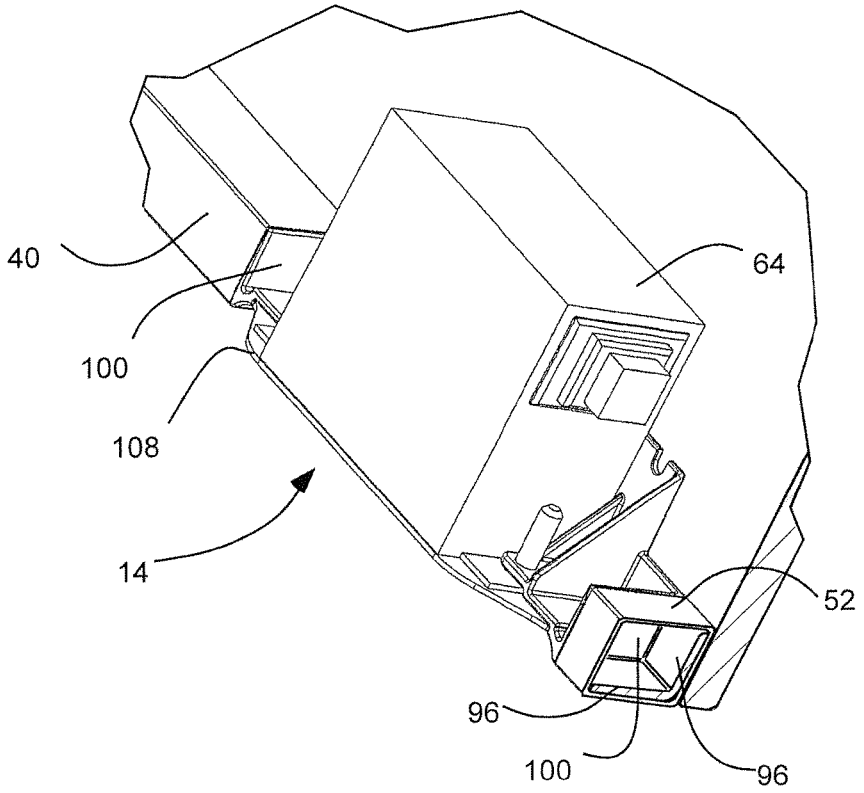
FIG. 13 is a partial cross-sectional perspective view of the power outlet of the table of FIG. 1, taken along line 13 of FIG. 7.

The wings 92 of the mounting bracket 56 can have at least two flanges 96. The flanges 96 can be oriented transverse to one another. In one aspect, the flanges can form an L-shape. The wings or flanges can be sized, shaped, oriented and/or positioned to mate, fit and/or nest in the open ends 52 of the rail 40. The wings or flanges 96 can abut to the inner walls or interior of the open ends 52 of the rail. In one aspect, the two flanges forming an L-shape can abut to at least two walls, respectively, of the perimeter rail, as shown in FIG. 13. Thus, the mounting bracket 56 is fixed with respect to the rail. In one aspect, fasteners, such as screws, bolts and/or adhesive, can secure the wings in the open rails, and thus secure the mounting bracket in the rail gap between the rail segments. In addition, the mounting bracket or the opposite wings 92 thereof can have a cap 100 (FIG. 5) extending across a respective opposing open end 52 of the perimeter rail 40, as shown in FIGS. 12 and 13. Thus, the caps 100 can close off or cover the opening in the open rails to resist accumulation of debris, and/or resist injury or snagging on the open ends of the rail. The cap 100 can extend from the wing and/or flanges, and can be oriented perpendicular to the wing and/or flanges.

Figure 3:
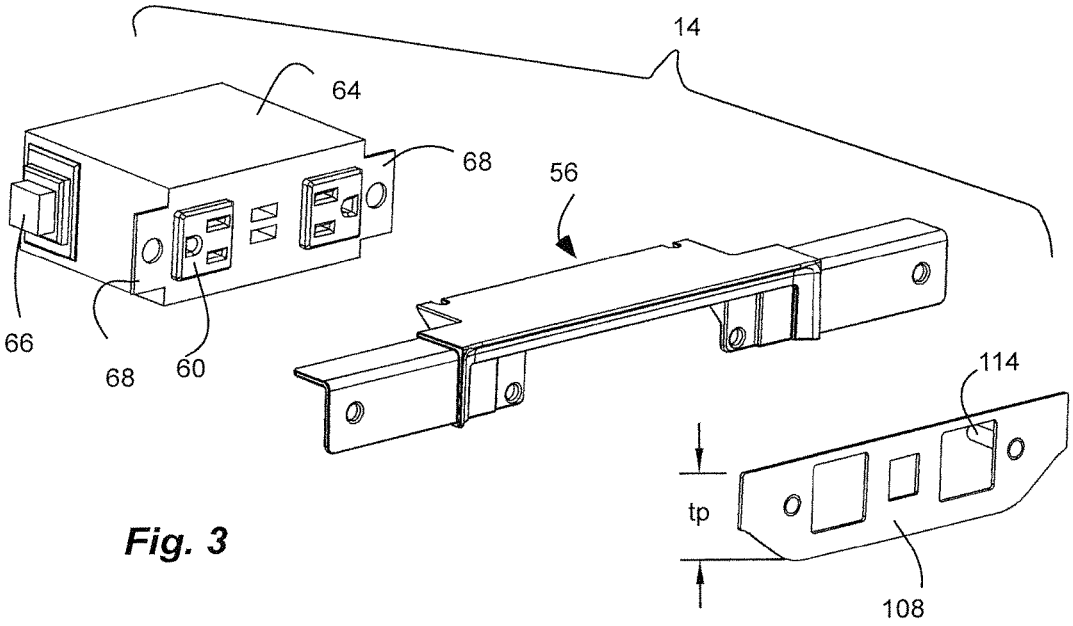
FIG. 3 is an exploded perspective view of the power outlet of the table of FIG. 1.

As indicated above, the mounting bracket 56 can carry the housing 64 with the plurality of electrical sockets 60. The central body 80 of the mounting bracket 56 can have a primary indentation or recess 104 (FIG. 4) in an outer face thereof, and that can be circumscribed by the molding 88. In one aspect, the primary indentation or recess 104 can be formed on opposite sides of the notch 84 of the central body 80. A faceplate 108 can be coupled to the mounting bracket 56, and received in the primary indentation or recess 104 of the central body 80, as shown in FIG. 6. The faceplate 108 can have a plurality of openings corresponding to the plurality of electrical sockets 60. The faceplate 108 can cover the notch 84 in the central body 80 of the mounting bracket 56. The plurality of electrical sockets 60 and the housing 64 can be thicker than the rail 40, and thus thicker than the mounting bracket 56 and the notch 84 therein. The housing 64 can have a thickness $t_o$ (perpendicular to the tabletop, as shown in FIG. 10) thicker than a thickness $t_m$ of the mounting bracket 56 (perpendicular to the tabletop, as shown in FIG. 10). Thus, the faceplate 108 can have a thickness $t_p$ (perpendicular to the tabletop, as shown in FIG. 3) that extends beyond the notch 84 of the central body 80, and beyond the primary indentation or recess 104 of the central body 80, with an outermost edge extending at least as far as a bottommost of the housing 64, as shown in FIGS. 12 and 13, to cover the housing and resist injury or snagging. The central body 80 of the mounting bracket 56 can have a secondary indentation or recess 112 (FIG. 4) in the outer face of the central body of the mounting bracket, and circumscribed by the primary indentation or recess 104. In one aspect, the secondary indentation or recess 112 can be formed on opposite sides of the notch 84 of the central body 80. The housing 64 can have a pair of flanges 68 (FIG. 3) extending from opposite lateral sides of the housing, and received in the secondary indentation or recess 112. The secondary indentation or recess 112 allows the face plate to abut to a front face of the housing, and the outer face of the central body.

The housing 64, the mounting bracket 56 and the faceplate 108 can be coupled together with the mounting bracket 56 carrying the housing 64 and the faceplate 108. In one aspect, the faceplate can comprise mounting bolts 114 (FIGS. 3 and 6) fixed thereto and extending through mounting holes in the mounting bracket and the housing. A nut (not shown) can be fastened to the mounting bolt. The mounting bolt can extend through the central body 80 (or secondary indentation or recess 112 thereof), and the flange 68 of the housing 64.

Figure 14:
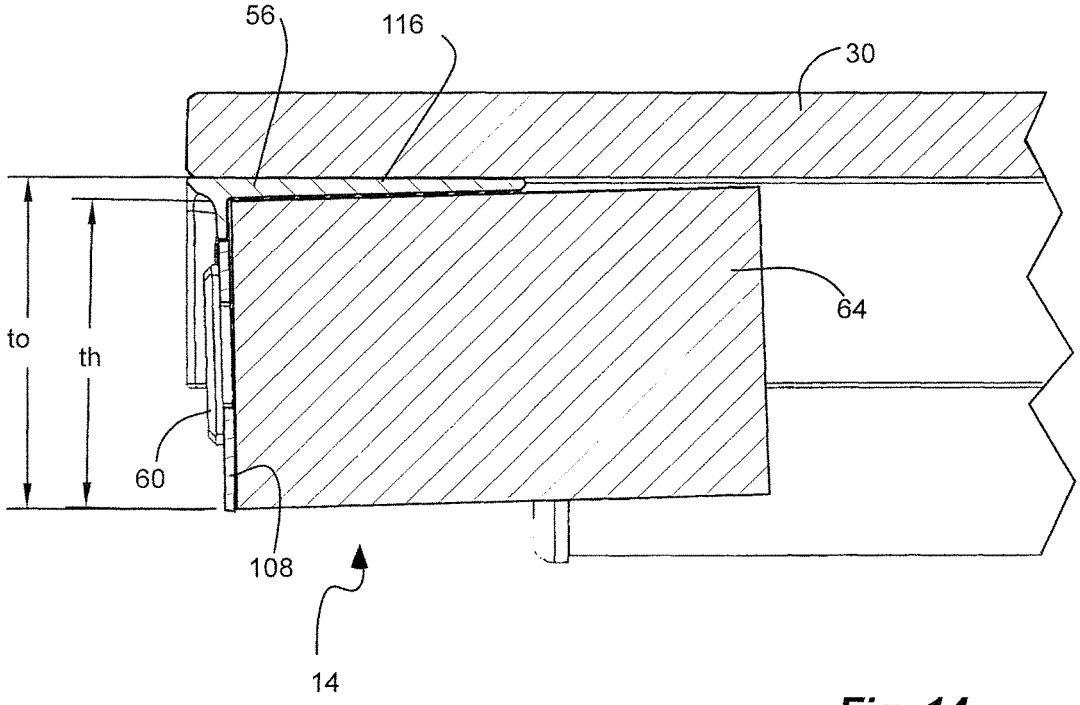
FIG. 14 is a partial cross-sectional side view of the power outlet and the table of FIG. 1, taken along line 14 of FIG. 7 (with the contents of a housing of the electrical socket being represented generically by cross-hatching).

Furthermore, the mounting bracket 56 can have an inner tab 116 (FIG. 5) extending inwardly from the central body 80 of the mounting bracket, and abutting to a lower surface of the tabletop, as shown in FIGS. 12 and 13. In addition, one or more braces 120 (FIG. 5) can extend between the central body 80 of the mounting bracket and the inner tab 116, and thus the tabletop. The inner tab and the braces can provide support to the housing and the plurality of electrical sockets as force is applies by a user to insert a plug into the socket. The plurality of electrical sockets 60 can extend from the housing, but can be recessed with respect to the perimeter of the tabletop, as shown in FIG. 6, thus reducing snagging. The electrical power outlet 14 can have an outermost perimeter that is substantially flush with the perimeter of the tabletop. In one aspect, the housing 64 can nest between a pair of the braces 120, as shown in FIG. 6, to help secure the electrical outlets laterally. In addition, the housing can be oriented at a slight angle with respect to the tabletop, and the housing can extend from the mounting bracket to the bottom of the tabletop, and abut thereto, as shown in FIG. 14, to help stabilize the housing, and thus the electrical sockets.

In one aspect, the power outlet 14, or portions thereof, such as the housing 64 with the electrical outlets 60, and the faceplate 100, can be removable and replaceable with respect to the table 10, the rail 40, and/or the mounting bracket 56. Thus, different configurations of electrical outlets 60 can be provided or replaced.

In one aspect, the foldable table with a power outlet can have a single power outlet on a single side of the table. For example, the table can be a conference type table or classroom type table configured to receive users seated along a single side (a back or proximal side, and long side) of the table, with the other opposite side (a front or distal side) facing towards a front of a room, a presenter, or the like. The power outlet can be disposed on a back or proximal side of the table, facing towards a user or person seated at the table. As another example, the power outlet can be disposed on a front or distal side of the table, facing away from a user or person seated at the table. In another aspect, the folding table with a power outlet can have multiple power outlets. For example, the table can have a single power outlet on each opposite side of the table. As another example, the table can have multiple power outlets along a side of the table. As another example, a long table can have a foot gap that is wide and that can accommodate multiple power outlets in series. The multiple power outlets can be adjacent one another, or can be spaced-apart from one another. In one aspect, the power outlet can be disposed on a long side of the table. In another aspect, the power outlet can be disposed on a short side of the table. In another aspect, the power outlet can be long or wide with multiple electrical sockets arrayed in series along a long length or width of the outlet.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A folding table, comprising:

a) a tabletop with a horizontal orientation supported in an elevated position with respect to a support surface by at least a pair of legs or leg assemblies pivotally coupled at opposite sides of the tabletop and pivotal between a closed storage position against the tabletop and an open elevated position extending transverse between the support surface and the tabletop;

b) the tabletop having a bottom framework with a perimeter rail extending along at least a portion of a perimeter the tabletop and defining at least a portion of the perimeter of the tabletop;

c) the perimeter rail being segmented and defining a rail gap in the perimeter rail, the perimeter rail having opposing ends at the rail gap; and d) an electrical power outlet spliced into the perimeter rail at the rail gap and spanning the rail gap in the perimeter rail, the perimeter rail and the electrical power outlet together defining a continuous perimeter.

2. The table in accordance with claim 1, wherein the perimeter rail is segmented into separate and discrete rail segments; and wherein the electrical power outlet joins the rail segments together.

3. The table in accordance with claim 1, wherein the at least a pair of legs or leg assemblies have feet that oppose one another in the closed storage position against the tabletop and define a foot gap therebetween, the foot gap having a width parallel with the tabletop defined between the feet, and a depth perpendicular to the tabletop; and wherein the electrical power outlet has a plurality of electrical sockets carried in a housing; and wherein the housing of the electrical power outlet has a thickness perpendicular to the tabletop less than the depth of the foot gap, such that the housing is recessed in the foot gap in the closed storage position, and the housing has a width parallel with the tabletop less than the width of the foot gap such that the feet clear the housing in the closed storage position.

4. The table in accordance with claim 1, wherein the electrical power outlet further comprises:

a plurality of electrical sockets carried in a housing; and a mounting bracket coupled to the perimeter rail and carrying the housing.

5. The table in accordance with claim 4, wherein the perimeter rail is tubular with a hollow interior; and wherein the opposing ends of the perimeter rail at the rail gap are opposing open ends; and wherein the mounting bracket comprises opposite wings extending into the opposing open ends, respectively, of the perimeter rail at the rail gap.

6. The table in accordance with claim 5, wherein each of the opposite wings of the mounting bracket have:

at least two flanges forming an L-shape to abut to at least two walls, respectively, of the perimeter rail.

7. The table in accordance with claim 5, further comprising:

each of the opposite wings having a cap extending across a respective opposing open end of the perimeter rail.

8. The table in accordance with claim 4, wherein the electrical power outlet further comprises:

a) the mounting bracket having a central body spanning the rail gap between the opposing ends of the perimeter rail, the central body having a notch between the opposing ends of the perimeter rail to accommodate the plurality of electrical sockets at least partially between the opposing ends of the perimeter rail, and the mounting bracket having a molding circumscribing the notch with the molding being substantially flush with the perimeter rail;

b) the central body of the mounting bracket having a primary indentation or recess in an outer face thereof and circumscribed by the molding; and c) a faceplate coupled to the mounting bracket and received in the primary indentation or recess of the central body, the faceplate having a plurality of openings corresponding to the plurality of electrical sockets.

9. The table in accordance with claim 8, wherein the housing has a thickness perpendicular to the tabletop thicker than a thickness of the mounting bracket perpendicular to the tabletop; and wherein the faceplate has a thickness perpendicular to the tabletop that extends beyond the notch and with an outermost edge extending at least as far as a bottommost of the housing.

10. The table in accordance with claim 8, further comprising:

a secondary indentation or recess in the outer face of the central body of the mounting bracket circumscribed by the primary indentation or recess; and a pair of flanges extending from opposite lateral sides of the housing and received in the secondary indentation or recess.

11. The table in accordance with claim 8, further comprising:

an inner tab extending inwardly from the central body of the mounting bracket and abutting to a lower surface of the tabletop.

12. The table in accordance with claim 11, further comprising:

a brace extending between the central body of the mounting bracket and the inner tab.

13. The table in accordance with claim 4, wherein the plurality of electrical sockets are recessed with respect to the perimeter of the tabletop.

14. The table in accordance with claim 1, wherein the electrical power outlet has an outermost perimeter that is substantially flush with the perimeter of the tabletop.

15. A folding table, comprising:

a) a tabletop with a horizontal orientation supported in an elevated position with respect to a support surface by at least a pair of legs or leg assemblies pivotally coupled at opposite sides of the tabletop and pivotal between a closed storage position against the tabletop and an open elevated position extending transverse between the support surface and the tabletop;

b) the tabletop having a bottom framework with a perimeter rail extending along at least a portion of a perimeter the tabletop and defining at least a portion of the perimeter of the tabletop;

c) the perimeter rail being segmented and defining a rail gap in the perimeter rail, the perimeter rail having opposing ends at the rail gap;

d) an electrical power outlet spliced into the perimeter rail at the rail gap and spanning the rail gap in the perimeter rail, the perimeter rail and the electrical power outlet together defining a continuous perimeter;

e) the at least a pair of legs or leg assemblies having feet that oppose one another in the closed storage position against the tabletop and define a foot gap therebetween, the foot gap having a width parallel with the tabletop defined between the feet, and a depth perpendicular to the tabletop;

f) the electrical power outlet having a plurality of electrical sockets carried in a housing; and g) the housing of the electrical power outlet having a thickness perpendicular to the tabletop less than the depth of the foot gap, such that the housing is recessed in the foot gap in the closed storage position, and the housing has a width parallel with the tabletop less than the width of the foot gap such that the feet clear the housing in the closed storage position.

16. The table in accordance with claim 15, further comprising:

a) the electrical power outlet having a mounting bracket coupled to the perimeter rail and carrying the housing;

b) the perimeter rail being tubular with a hollow interior;

c) the opposing ends of the perimeter rail at the rail gap being opposing open ends; and d) the mounting bracket comprising opposite wings extending into the opposing open ends, respectively, of the perimeter rail at the rail gap.

17. The table in accordance with claim 15, wherein the electrical power outlet further comprises:

a) the mounting bracket having a central body spanning the rail gap between the opposing ends of the perimeter rail, the central body having a notch between the opposing ends of the perimeter rail to accommodate the plurality of electrical sockets at least partially between the opposing ends of the perimeter rail, and the mounting bracket having a molding circumscribing the notch with the molding being substantially flush with the perimeter rail;

b) the central body of the mounting bracket having a primary indentation or recess in an outer face thereof and circumscribed by the molding; and c) a faceplate coupled to the mounting bracket and received in the primary indentation or recess of the central body, the faceplate having a plurality of openings corresponding to the plurality of electrical sockets.

18. A folding table device, comprising:

a) a tabletop with a horizontal orientation supported in an elevated position with respect to a support surface by at least a pair of legs or leg assemblies pivotally coupled at opposite sides of the tabletop and pivotal between a closed storage position against the tabletop and an open elevated position extending transverse between the support surface and the tabletop;

b) the tabletop having a panel with an uppermost surface defining a working surface, and a bottom framework supporting the panel;

c) the framework having a perimeter rail extending along at least a portion of a perimeter of the panel and being substantially flush with the perimeter of the panel, the perimeter of the panel and the perimeter rail defining a perimeter of the tabletop, the perimeter rail being tubular with a hollow interior;

d) the at least a pair of legs or leg assemblies having feet that oppose one another in the closed storage position against the tabletop and defining a foot gap therebetween, the foot gap having a width parallel with the tabletop defined between the feet, and a depth perpendicular to the tabletop;

e) the perimeter rail being segmented at the foot gap and defining a rail gap in the perimeter rail, the perimeter rail having opposing open ends at the rail gap;

f) an electrical power outlet spliced into the perimeter rail at the foot gap and spanning the rail gap in the perimeter rail, the perimeter rail and the electrical power outlet together defining a continuous perimeter;

g) the electrical power outlet having an outermost perimeter that is substantially flush with the perimeter of the tabletop;

j) the electrical power outlet having a plurality of electrical sockets carried in a housing;

k) the electrical power outlet having a mounting bracket coupled to the perimeter rail and carrying the housing;

l) the mounting bracket having a central body spanning the rail gap between the opposing open ends of the perimeter rail, the central body having a notch between the opposing open ends of the perimeter rail to accommodate the plurality of electrical sockets at least partially between the opposing open ends of the perimeter rail, and the mounting bracket having a molding circumscribing the notch with the molding being substantially flush with the perimeter rail;

m) the mounting bracket having opposite wings extending from the central body and inserted into the opposing open ends, respectively, of the perimeter rail at the rail gap, the wings being recessed with respect to the molding;

n) the central body of the mounting bracket having a primary indentation or recess in an outer face thereof and circumscribed by the molding;

o) a faceplate coupled to the mounting bracket and received in the primary indentation or recess of the central body, the faceplate having a plurality of openings corresponding to the plurality of electrical sockets; and p) the housing of the electrical power outlet having a thickness perpendicular to the tabletop less than the depth of the foot gap, such that the housing is recessed in the foot gap in the closed storage position, and the housing having a width parallel with the tabletop less than the width of the foot gap such that the feet clear the housing in the closed storage position.

19. The table in accordance with claim 18, wherein each of the opposite wings of the mounting bracket have:

at least two flanges forming an L-shape to abut to at least two walls, respectively, of the perimeter rail.

20. The table in accordance with claim 19, further comprising:

each of the opposite wings having a cap extending across a respective opposing open end of the perimeter rail.

* * * * *